US010112385B2

(12) United States Patent
Valle de la Munoza et al.

(10) Patent No.: US 10,112,385 B2
(45) Date of Patent: Oct. 30, 2018

(54) AMBIENT TEMPERATURE BASED FLOW RATES

(71) Applicant: HEWLETT-PACKARD DEVELOPMENT COMPANY, L.P., Houston, TX (US)

(72) Inventors: Cristina Valle de la Munoza, Barcelona (ES); Jeffrey A Wagner, Vancouver, WA (US); Justin M Roman, Portland, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/519,856

(22) PCT Filed: Oct. 31, 2014

(86) PCT No.: PCT/US2014/063298
§ 371 (c)(1),
(2) Date: Apr. 18, 2017

(87) PCT Pub. No.: WO2016/068967
PCT Pub. Date: May 6, 2016

(65) Prior Publication Data

US 2017/0246858 A1 Aug. 31, 2017

(51) Int. Cl.
*B41J 2/045* (2006.01)
*B41J 25/00* (2006.01)
*B41J 2/175* (2006.01)

(52) U.S. Cl.
CPC ..... *B41J 2/04535* (2013.01); *B41J 2/04586* (2013.01); *B41J 2/175* (2013.01); *B41J 25/003* (2013.01)

(58) Field of Classification Search
CPC .... B41J 2/04535; B41J 2/04586; B41J 2/175; B41J 25/003; B41J 29/38; B41J 29/393
USPC ..... 347/6
See application file for complete search history.

(56) References Cited

U.S. PATENT DOCUMENTS 4,490,796 A * 12/1984 Bigbie ..... H02P 23/22 318/561
4,555,712 A 11/1985 Arway et al.
5,610,638 A 3/1997 Courtney et al.
6,452,618 B1 * 9/2002 Heim ..... B41J 2/04515 347/140
7,091,999 B2 8/2006 Okuchi et al.
(Continued)

FOREIGN PATENT DOCUMENTS

CN 86100822 A 11/1986
CN 1217502 A 5/1999
(Continued)

OTHER PUBLICATIONS

KYOCERA Corporation, Printing Speed, Sep. 16, 2014.

*Primary Examiner* — Huan Tran
*Assistant Examiner* — Alexander D Shenderov
(74) *Attorney, Agent, or Firm* — Brooks Cameron & Huebsch PLLC

(57) ABSTRACT

Ambient temperature based flow rates can in an example include a setting a flow rate of ink to a printhead mounted in a carriage based on an ambient temperature associated with the printhead, measuring a flow rate of ink to the printhead, and causing a decrease in a velocity of the carriage in response to the flow rate of ink satisfying the threshold flow rate.

14 Claims, 5 Drawing Sheets

(56) References Cited

U.S. PATENT DOCUMENTS

| | | | | |
|---|---|---|---|---|
| 8,292,392 | B2 | 10/2012 | Snyder et al. | |
| 8,297,728 | B2 | 10/2012 | Richards et al. | |
| 8,500,228 | B2 | 8/2013 | Aono et al. | |
| 2003/0202055 | A1 | 10/2003 | Jeanmaire et al. | |
| 2006/0203027 | A1 | 9/2006 | Espasa et al. | |
| 2008/0043076 | A1* | 2/2008 | Coffey | B41J 2/17513 347/92 |
| 2009/0073201 | A1 | 3/2009 | Watanabe et al. | |
| 2010/0079515 | A1 | 4/2010 | Kuwahara et al. | |
| 2010/0321427 | A1 | 12/2010 | Richards et al. | |
| 2013/0050337 | A1 | 2/2013 | Jogo et al. | |

FOREIGN PATENT DOCUMENTS

| | | | |
|---|---|---|---|
| CN | 1257448 | A | 6/2000 |
| CN | 102029821 | A | 4/2011 |
| JP | 2002240312 | A | 8/2002 |

* cited by examiner

AMBIENT TEMPERATURE BASED FLOW RATES

BACKGROUND

Various printers such as ink-jet printers may operate by moving a carriage that includes a printhead with nozzles above portions of a print medium and applying a quantity of ink from the nozzles as they pass over specified pixel locations on the print medium. That is, each of the nozzles may be controlled to produce a desired pixel pattern as the printhead moves over the print medium.

DETAILED DESCRIPTION

Figure 1:
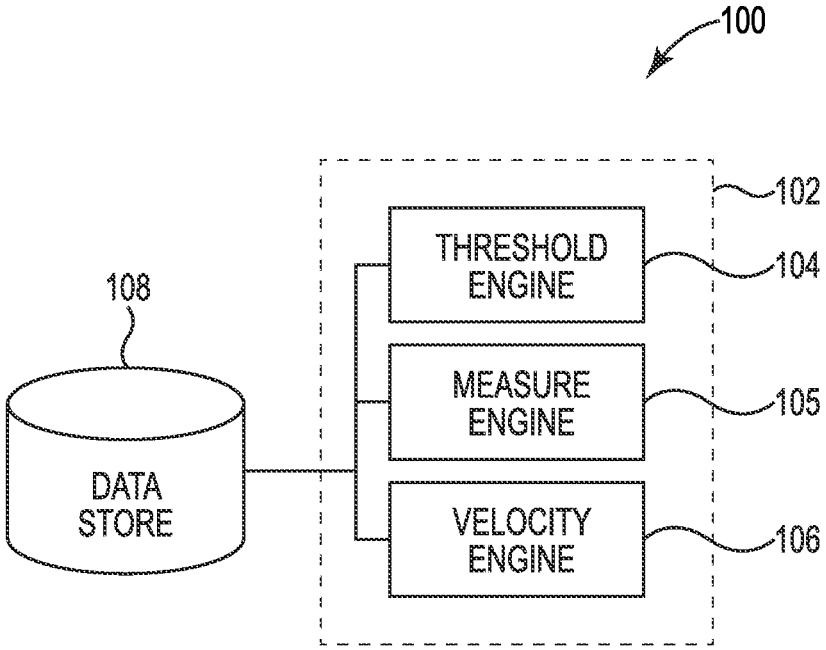
FIG. 1 illustrates a diagram of an example of a system for ambient temperature based flow rates according to the present disclosure.

With increasing pressure on organizations to improve their performance, the organizations may seek to increase efficiencies of services and/or products provided, for instance, by pursuing improved performance (e.g., comparatively increased print quality and/or printing speed) of printers. Various printers such as ink jet printers may operate by moving a carriage that includes a printhead with nozzles above portions of a print medium and applying a quantity of ink from the nozzles as they pass over specified pixel locations on the print medium. That is, each of the nozzles may be controlled to produce a desired pixel pattern as the printhead moves over the print medium. That is, a printer uses a printhead that passes repeatedly across a print medium in individual swaths.

The printer may monitor a value of a print density and a value of a printhead temperature during printing each printhead swath. It may use these values to calculate, prior to each new swath, a threshold (e.g., maximum permissible) print density. When a reduction in a print density is desired, the printer may temporarily reduce the printhead velocity relative to the print medium to account for such reduction(s) in an effort to maintain a desired print quality. That is, it can be beneficial to comparatively reduce a speed of a printhead when a print density of a particular swath exceeds a threshold print density. However, printhead speed reduction may rely upon a particular fixed value of the threshold print density. Further, these approaches may overcompensate when reducing speed of a printhead due to reliance on a particular fixed value and/or may not account for variances (e.g., variance due to fluctuations in ambient temperature) in an amount of ink flow provided to a printhead. Put another way, use of a fixed value may lead to reducing a speed of the printhead in a manner that undesirably imparts printing artifacts and/or reduces a print speed to less than a comparatively faster print speed that would also be suitable to provide a desired print quality, among other difficulties.

Moreover, such approaches may not account for pressure drop occurring along a path from an ink supply to the printhead. The pressure drop can vary in accordance with variations in ambient temperature associated with an ink supply and/or printhead. Such a pressure drop can be based on (e.g., a sum of) respective pressures drops associated with supply interconnects, supply tubes, and/or a difference in height between a height of an ink supply and a height of the printhead, among other factors. The pressure drop occurs regardless of size(s) of component(s) but can be particularly evident when using supply tubes having comparatively narrow tubes (e.g., tubes having a diameter of equal to or less than 2 millimeters).

In contrast, examples of the present disclosure include methods, systems, and computer-readable media with executable instructions stored thereon for ambient temperature based flow rates. Ambient temperature based flow rates can, for example, include setting a flow rate of ink to a printhead mounted in a carriage based on an ambient temperature associated with the printhead, measuring a flow rate of ink to the printhead, and causing a decrease in a velocity of the carriage in response to the flow rate of ink satisfying the threshold flow rate. Such ambient temperature based flow rates can facilitate maintain a balance between a desired image quality and a desired printing speed while reducing carriage speed when a flow rate satisfies a threshold flow rate based on ambient temperature.

FIG. 1 illustrates a diagram of an example of a system for ambient temperature based flow rates according to the present disclosure. The system 100 can include a data store 108, ambient temperature based flow rate system 102, and/or a number of engines. The ambient temperature based flow rate system 102 can be in communication with the data store 108. The ambient temperature based flow rate system 102 can include a number of engines (e.g., a threshold engine 104, a measure engine 105, a velocity engine 106, etc.). The ambient temperature based flow rate system 102 can include additional or fewer engines than illustrated to perform the various functions described herein.

The number of engines can include a combination of hardware and programming to perform a number of functions described herein (e.g., a threshold engine to set a threshold flow rate of ink to a printhead mounted in a carriage based on an ambient temperature associated with the printhead, etc.). Each of the engines can include hardware or a combination of hardware and programming designated or designed to execute a module (e.g., a particular module). The programming can include instructions (e.g., software, firmware, etc.) stored in a memory resource (e.g., computer-readable medium) as well as a hard-wired program (e.g., logic).

The threshold engine 104 is to set a threshold flow rate of ink to a printhead mounted in a carriage, as described herein, based on an ambient temperature associated with the printhead. A threshold flow rate of ink is a particular value of volumetric flow rate of ink through tubes that couple the ink supply to the printhead that is based on the ambient temperature associated with the printhead. That is, setting a threshold value can include setting a particular numeric value of a threshold flow rate (e.g., a particular volumetric flow rate) based on an ambient temperature associated with the printhead. Setting a threshold flow rate of ink can occur in response to receipt of a print job by a printer and/or after completion of a swath of a print job by the printer, among other possibilities. Such a value can be set automatically (without user input) using various threshold values in a lookup table.

For example, a value in a lookup table such as 6 cubic centimeters/minute (cc/min) can correspond to a particular measured ambient temperature and/or a particular range of measured ambient temperatures (e.g., measured ambient temperatures in a range a predetermined base temperature such as below 15° C.), while another value in a lookup table such as 9 cc/min can correspond to another particular measured ambient temperature and/or another particular range of measured ambient temperatures (e.g., measured ambient temperatures between a predetermined intermediate temperature to a predetermined upper temperature such as in between 25° C. to 15° C., respectively), while yet another value in the lookup table such as 12 cc/min can correspond to yet another range of measured ambient temperatures (e.g., measured ambient temperatures above a predetermined upper temperature such as above 25° C.). Any suitable number of temperature(s) and/or temperature ranges with a corresponding value(s) of threshold flow rates can be used to promote ambient temperature based flow rates. That is, a value of a threshold flow rate varies with ambient temperature. In this manner, the value in the lookup table such as a look up table stored in a data store can be used to as a threshold flow rate and/or can be used to calculate a threshold swath dot density, as described herein.

The measure engine 105 is to measure a flow rate of ink to the printhead. The measure engine can compare a measured value of a flow rate of ink to the printhead with a value of a threshold flow rate of ink to the printhead. Measurement can be continuous, periodic (e.g., hourly, daily, etc.), and/or can occur in response to an input (e.g., automatically in response to receipt of a print job be a printer and/or in response to a user input). The flow rate of ink to a printhead can be measured directly from a sensor(s)(not shown) located along a path of ink from an ink supply to a printhead and/or can be measure indirectly based upon density measurements, such as those described herein.

When a measured flow rate (e.g., a volumetric flow rate) satisfies (e.g., meets or exceeds) a threshold flow rate a velocity of a carriage can be decreased. For instance, the velocity engine 106 is to cause a decrease in a velocity of the carriage in response to the flow rate of ink satisfying the threshold flow rate. However, the present disclosure is not so limited. Rather, the velocity engine 106 can, in some examples, cause a decrease in a velocity of a carriage based on a determined density, as described herein, satisfying a density threshold that is based on the ambient temperature. That is, the velocity engine 106 can cause a decrease in a velocity of a carriage in response to flow rate of ink and/or a swath dot density satisfying a threshold flow rate of ink and/or a threshold swath dot density, respectively. Notably, in any case, both the threshold flow rate of ink and the threshold swath are based upon an ambient temperature associated with a printhead, in contrast to other approaches that may employ a fixed value which does not account for variations in printer performance such as those associated with variations in ambient temperature. For instance, it is notable that a comparative increase in an ambient temperature can correspond to a comparative increase in a threshold volumetric flow rate of ink due to temperature based changes in viscosity of the ink and/or temperature based changes in an amount of pressure drop associated with providing the ink to a printhead.

A decrease in the velocity of the carriage can be caused by comparatively decreasing at least one of a voltage and/or a pulse width of a voltage applied to a motor associated with the carriage, among other ways suitable to decrease a velocity of the carriage. In some examples, the velocity engine 106 can decrease the velocity of the carriage on an upcoming print swath sufficient to reduce the flow of ink rate of ink to below the threshold flow rate during printing of the print swath. In some examples, a determine engine (not shown) can determine a swath dot density associated with a stored image being printed by the printhead, as described herein.

Figure 2:
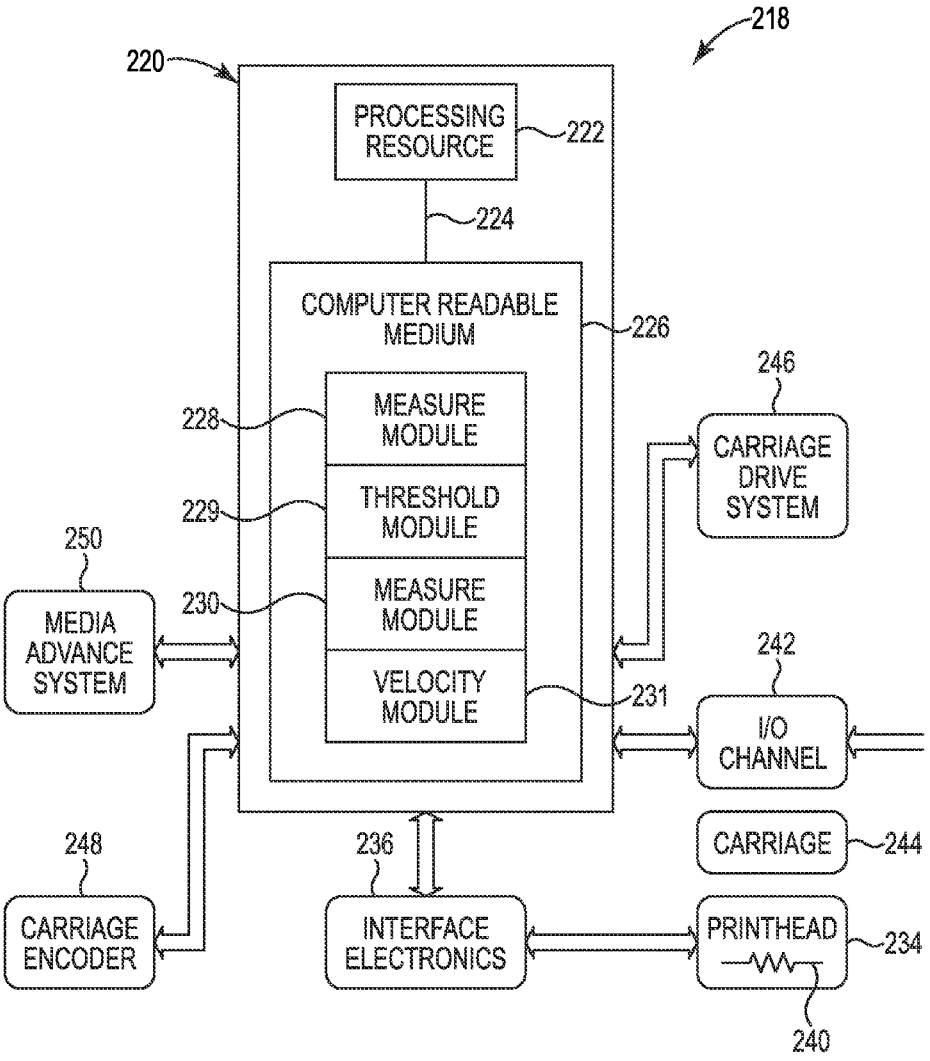
FIG. 2 illustrates a diagram of an example of a printer including an example of a computing device according to the present disclosure.

FIG. 2 illustrates a diagram of an example of a printer including an example of a computing device according to the present disclosure. Printer 218 can be an ink-jet printer having a printhead 234. The printhead can have multiple nozzles (not shown). Interface electronics 236 are associated with printer 218 to interface between the control logic components and the electro-mechanical components of the printer. Interface electronics 236 can include circuits for moving the printhead and media, and for firing individual nozzles in the printhead.

A temperature sensor 240 is associated with the printhead. It is operably connected to supply a printhead temperature measurement such as an ambient temperature associate with the printhead to the control logic through interface electronics 236. The temperature sensor can be a thermal sense resistor, among other suitable temperature sensors. The temperature sensor 240 can output information (e.g., a digital stream of information) indicative of measured ambient temperatures among other information. For example, the temperature sensor 240 can produce an analog signal that can be digitized within interface electronics 236 so that it can be read by processing resource 222. Processing resource 222 is connected to receive instructions and data through a I/O channel(s), ports 242, and/or wirelessly, among other possibilities from a host computer (not shown) and/or from a cloud such as those suitable for cloud based printing.

Printhead 234 includes laterally spaced nozzles and/or dot columns. Each nozzle is positioned at a different vertical position (where the direction of printhead travel, at a right angle to the direction of printhead travel), and corresponds to a respective pixel row on the underlying print medium. In most swaths of the printhead, all nozzles are used resulting in what is referred to herein as a full-height swath.

Printhead 234 can be responsive to control logic implemented by the processor resource 222 and memory computer readable medium 226 to pass repeatedly across a print medium in individual, horizontal swaths. The printhead 234 is mounted in a carriage 244, which is mounted for sliding movement along a swath axis to print a swath. The carriage is coupled to a carriage drive system 244, which is controlled by the control logic to drive the carriage in a controlled manner. A carriage encoder 248 provides position information to the control logic so that the control logic can monitor the position and hence the velocity of the carriage as it is moved by the drive system 244 in response to commands from the control logic. A media advance system 250 is also controlled by the control logic to drive and position the print media along a media path which can be transverse to the swath axis.

The individual nozzles of the printhead are fired repeatedly during each printhead swath to apply an ink pattern to the print medium. In some printers, the swaths overlap each other so that the printhead passes over each pixel row two or more times.

The computing device 220 can utilize software, hardware, firmware, and/or logic to perform a number of functions described herein. For example, the computing device 220 can be a combination of hardware and instructions for ambient temperature based flow rates. The hardware, for example can include a processing resource 222 and/or a memory resource 226 (e.g., computer-readable medium (CRM), data store, etc.)

A processing resource 222, as used herein, can include a number of processors capable of executing instructions stored by a memory resource 226. Processing resource 222 can be integrated in a single device or distributed across multiple devices (e.g., multiple servers). The instructions (e.g., computer-readable instructions (CRI)) can include instructions stored on the memory resource 226 and executable by the processing resource 222 to implement a desired function (e.g., measure an ambient temperature associated with a printhead, etc.).

The memory resource 226 can be in communication with a processing resource 222. A memory resource 226, as used herein, can include a number of memory components capable of storing instructions that can be executed by processing resource 222. Such memory resource 226 can be a non-transitory CRM. Memory resource 226 can be integrated in a single device or distributed across multiple devices. Further, memory resource 226 can be fully or partially integrated in the same device as processing resource 222 or it can be separate but accessible to that device and processing resource 222. Thus, it is noted that the computing device 220 can be implemented as part of or in conjunction with the systems and printers, as described herein.

The memory resource 226 can be in communication with the processing resource 222 via a communication link (e.g., path) 224. The communication link 224 can be local or remote to a computing device associated with the processing resource 222. Examples of a local communication link 224 can include an electronic bus internal to a computing device where the memory resource 226 is one of volatile, non-volatile, fixed, and/or removable storage medium in communication with the processing resource 222 via the electronic bus.

The memory resource 226 can include a number of modules such as a measure module 228, a threshold module 229, a measure module 230, a velocity module 231, etc. The number of modules 228, 229, 230, 231 can include CRI that when executed by the processing resource 222 can perform a number of functions. The number of modules 228, 229, 230, 231 can be sub-modules of other modules. For example, the measure module 228 and the threshold module 229 can be sub-modules and/or contained within the same computing device. Similarly, the measure module 228 and the measure module 230 can be sub-modules and/or contained within the same computing device. In another example, the number of modules 228, 229, 230, 231 can comprise individual modules at separate and distinct locations (e.g., CRM, etc.).

Each of the number of modules 228, 229, 230, 231 can include instructions that when executed by the processing resource 222 can function as a corresponding engine, including those as described herein. For example, the measure module 230 can include instructions that when executed by the processing resource 222 can function as a measure engine 105, for instance, to measure an ambient temperature associated with a printhead. A threshold module 229 can function as the threshold engine 104 to set a threshold flow rate of ink to a printhead mounted in a carriage based on an ambient temperature associated with the printhead.

The measure module 228 can include instructions that when executed by the processing resource 222 can measure an ambient temperature associated with a printhead. Measure module can utilize temperature sensor 240 to measure an ambient temperature associated with a printhead. That is, a particular ambient temperature for a printhead can be measured prior to printing of a portion (page) of a printjob, among other possibilities. Put another way, in some examples, the measure module 228 can measure an ambient temperature of a printhead when the printhead is in an idle state (e.g., not printing a print job and/or has not experience a pre-printing warm up pules(s) such as those designed to raise a temperature of a printer to a suitable temperature for printing that is above an ambient temperature). That is, a particular ambient temperature can be measured at a given time (e.g., in advance of printing) for the printhead.

Such measurement can utilize a temperature sensor, as described herein, such as a temperature sensor located on the printhead. Notably, an ambient temperature (e.g., 22° C.) measured by a temperature sensor such as temperature sensor 240 associated with a printhead can be used to approximate an ambient temperature (e.g., equal to the 22° C.) associated with an ink. However, the present disclosure is not so limited. That is, a dedicated temperature sensor can, in some examples, be included on an ink supply and/or along an ink supply path to measure an ambient associated with the ink supply instead of and/or in addition to using of temperature sensor 240 to measure an ambient temperature of the printhead.

The set module 229 can include instructions that when executed by the processing resource 222 can set a threshold volumetric flow rate of ink from an ink supply to a printhead mounted in a carriage based on an ambient temperature, for example, based on the ambient temperature measured by measure module 228. Put another way, the threshold volumetric flow rate of ink is variable based on measured ambient temperatures associated with a printhead. For example, the set module 229 can set a threshold volumetric flow rate of ink to an upper threshold (e.g., 12 cc/min) when a measured ambient temperature is a predetermined upper temperature such as above 25° C., to an intermediate threshold (e.g., 9 cc/min) when a measured ambient temperature is in a range of from a predetermined intermediate temperature to a predetermined upper temperature such as from 15° C. to 25° C., respectively, or to a base threshold (e.g., 6 cc/min) when a measured ambient temperature is below a predetermined base temperature such as 15° C., among other possibilities.

The measure module 230 can include instructions that when executed by the processing resource 222 can measure a volumetric flow rate of ink from an ink supply to the printhead. For example, the measure module can, in some examples, measure a flow rate of ink as a volumetric flow rate of ink from the ink supply to the printhead, among other possibilities such a measuring a mass flow rate of ink from the ink supply to the printhead. The measure module 230 can include instructions that when executed by the processing resource 222 can decrease a velocity of the carriage in response to the volumetric flow rate of ink satisfying the threshold volumetric flow rate.

A velocity module 231 can function as the velocity engine 104 to a cause a decrease in a velocity of the carriage in response to the flow rate of ink satisfying the threshold flow rate. Such a decrease can be caused as previously described herein. Causing refers to directly imparting a decreased in a velocity of the carriage or communication with a device with an expectation of causing a decrease in a velocity of the carriage.

A carriage movement rate can be slowed down for selected swaths to reduce print density. The carriage rate reduction can be employed in response to any one of the following factors or conditions: (a) a high print density for the swath, which is predicted to raise the printhead temperature to an unacceptably high level; (b) a high print density for the swath that is predicted to lower nozzle ink supplies to unacceptably low levels; and/or (c) a measured flow rate of ink satisfies a threshold flow rate of ink from an ink supply to a printhead.

The control logic, described herein, can use some known values for a complete swath: an actual density, DACT, a maximum allowed printhead temperature, TMAX, the printhead temperature at the beginning of the swath, TSTART, an ambient temperature associated with a printhead, TAMBIENT, and/or an actual peak printhead temperature during the swath, TPEAK. However, the present disclosure is not limited to basing calculations on values from the complete swath. Rather, it can be employed when the swath is divided into discrete swath intervals, and the values are determined for each swath interval. Once a swath is completed, the actual density, DACT, is found by reading registers in the printer hardware, i.e. the controller memory in which the actual ink drop counts for each printhead are stored.

$$DMAX=DACT*A*B*C \quad \text{(Equation 1)}$$

where:

$A$=(CVELMAX/MECH_/CVELMAX), $B$=(TMAX−TSTART)/(TPEAK−TSTART),

CVELMAX is the maximum allowed carriage velocity for the swath, and

MECH_CVELMAX is the maximum velocity allowed for the print mode.

C is an ambient temperature factor (i.e., a derating factor) =a value of a threshold flow rate based on a measure ambient temperature, TAMBIENT/a predetermined value of a upper flow rate threshold of ink (e.g., 12 cc/min) that can be provided to a printhead.

Equation (Eq.) 1 yields the effective firing density which is a function of carriage velocity and a threshold flow rate based upon ambient temperature. Further, to ensure that the printheads do not run at a temperature greater than a set thermal limit TMAX, say 70° C., in one implementation, the printer and/or computing device 220 can build a swath and then estimates the expected average density DAVG for that swath or interval. Once the expected average density is known, the following swath-pre-processing equation, calculated prior to releasing the swath, is applied to determine the maximum allowed carriage velocity (CVELMAX) for that swath. The highest possible carriage velocity is the maximum velocity (MECH_CVELMAX) allowed for the print mode, and is limited to the actual carriage mechanism.

$$CVELMAX=MIN[((MECH-CVELMAX)*(DMAX)/(DAVG)),(MECH-CVELMAX)] \quad \text{(Eq. 2)}$$

Once the maximum allowed carriage velocity (CVELMAX) is calculated, the velocity can be floored to the next closest allowable carriage velocity based on the frequency response of the printhead. These two equations provide as benefits their adaptability to many writing systems constraints and their flexibility to future product changes, such as a faster carriage velocity or higher resolution printheads. In some examples, characterization of flight-time-compensation and ink-dry-time interactions can be included into Eq. 1 and/or Eq. 2.

The printing system can employ these equations to provide on the basis of complete swath parameters, e.g. the maximum print density and printhead temperatures measured or predicted over the entire print swath, i.e., a whole or full swath mode. While a whole swath mode can be satisfactory for many applications, there can be a possible disadvantage, in that drastically different swaths can end up with similar average densities and peak temperatures. In some examples, filtering can be employed to dampen noise associated with the calculated maximum allowed density, for example, this may occur for the calculation of CVELMAX when intra-swath techniques are not employed. For example, consider a worst-case type example, where the swath has four intervals. The print density is 100% for the first two swath intervals, and 0% for the last two swath intervals. For a full swath mode calculation, DACT will be 50%, which may not adequately address the disparate density values and resulting printhead temperature effects. To address the effects of a print density which is not uniform, the present disclosure can be applied in an intra-swath mode.

Dividing the swath into discrete intervals for the intra-swath mode allows an enhanced estimation of the printhead thermal response than if such estimation is based on the average density and peak temperature for an entire swath. Notably, using discrete swath interval calculations will be very similar to the whole swath implementation described herein aside from a comparative increase in CPU cycles used to perform calculations in the intra-swatch mode. However, when in an intra-swath mode, the DMAX and CVELMAX parameters will be calculated at discrete intervals across the swath and then the results will be statistically combined for the complete swath.

There are various techniques which could be used to combine the swath interval parameters. For example, before allowing a swath to print, for each interval, the parameter DAVG is estimated for each interval. The average value for DAVG over the intervals is then calculated. The density cannot be greater than 100 or less than 0. If the average value calculated is greater than 100 or less than 0, the parameter value is set to the boundary limit. Now the process to determine whether the swath can be allowed to be printed at the maximum carriage velocity is the same as for the full swath technique. After the swath is completed, the learning equation is applied to each interval and the DMAX values for each interval are averaged together to obtain the DMAX parameter value to be used for the next swath.

Figure 3:
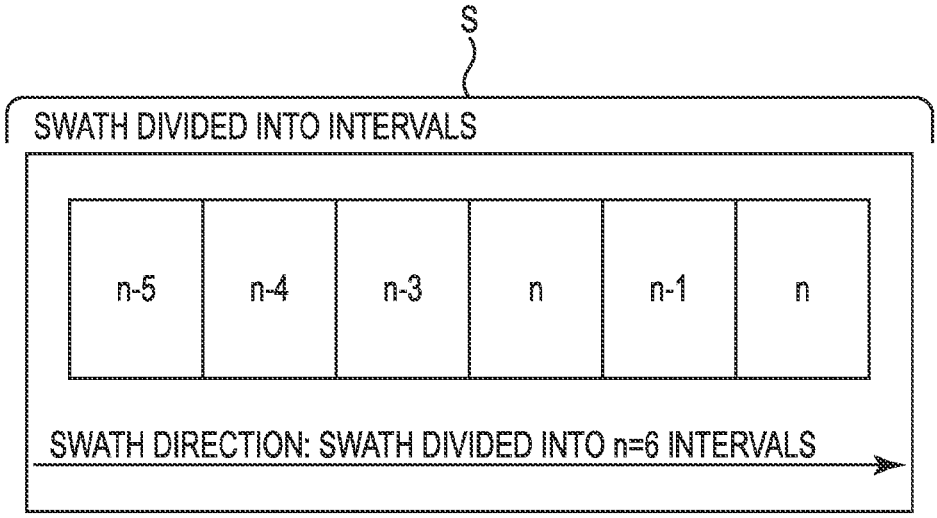
FIG. 3 illustrates an example of a print swath according suitable for ambient temperature based flow rates according to the present disclosure.

FIG. 3 illustrates an example of a print swath according suitable for ambient temperature based flow rates according to the present disclosure. As illustrated in FIG. 3, a printhead swath, s, can be divided into swath intervals, n, such as for use in an intra-swatch mode. For instance, as illustrated in FIG. 3, the printhead swath, s, can be divided into such that n=6 swath intervals, among other possibilities.

Figure 4:
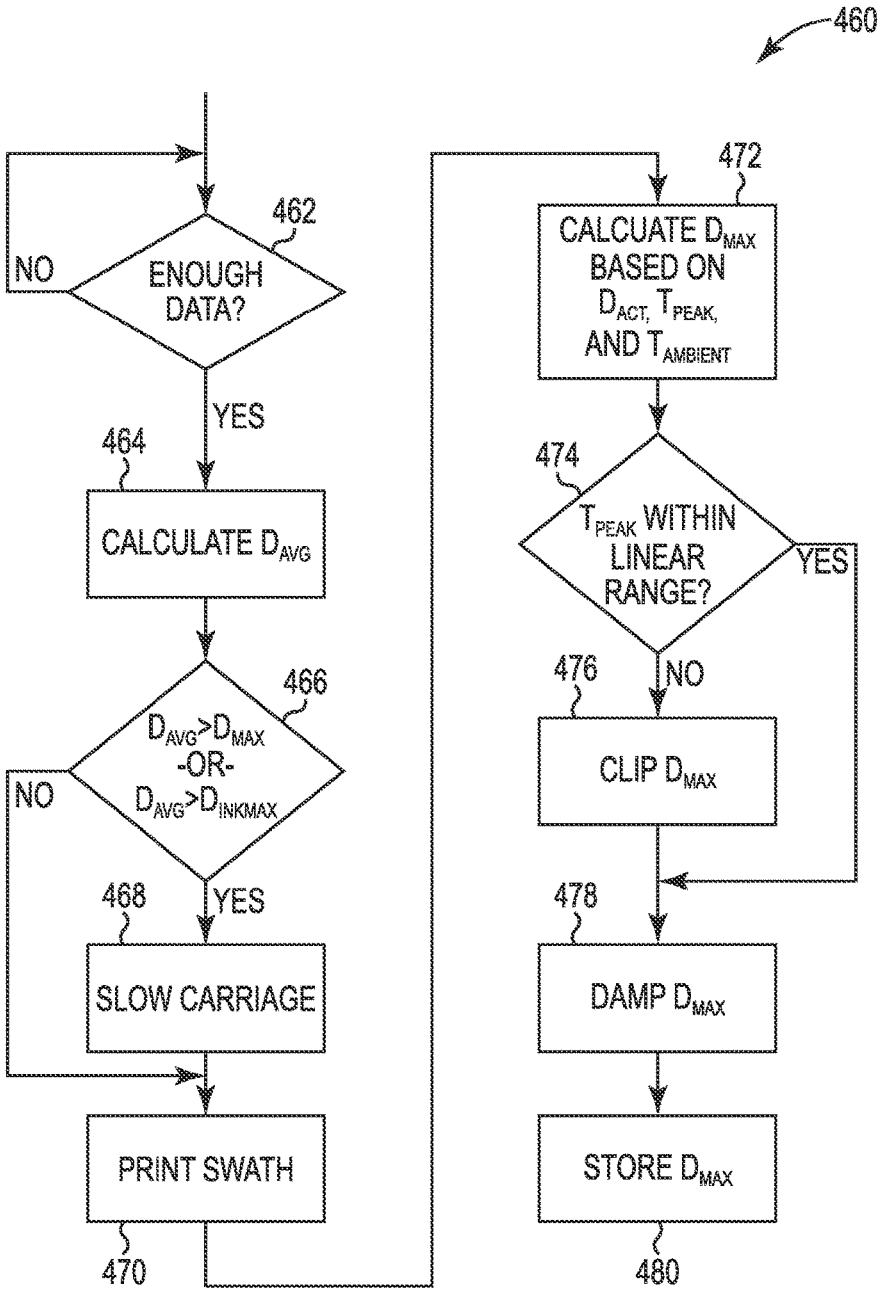
FIG. 4 illustrates a flow diagram of an example of a method for ambient temperature based flow rates according to the present disclosure.

FIG. 4 illustrates a flow diagram of an example of a method for ambient temperature based flow rates according to the present disclosure. The method can be performed by the control logic of a printer and can be repeated prior to every printhead swath for the full swath mode, and for each swath interval for the intra-swath mode.

At 462 the method 460 includes checking whether enough data has been received from the host computer to print an entire swath. Once enough data has been received to print a swath, execution proceeds to 464.

464 involves calculating the average swath dot density DAVG for the upcoming swath. This is done by building the upcoming swath and estimating the expected average density DAVG. At 466 it is determined whether the carriage velocity is to be slowed to reduce the effective print density. This can include comparing DAVG to DMAX, where DMAX is calculated using the learning equation set out above upon completion of the prior swath. In some examples, 466 can include determining whether the carriage should be slowed because the ink flow rate to the printhead is nearing or exceeding a threshold. For many applications, a limiting factor can be a thermal limitation and/or ink flow to the printhead. For example, ink flow can be a limiting factor, and in this case, a density parameter DMAXINK can be created, which is a maximum density value which can be printed by the printhead without damage. If this variable exceeds some predetermined threshold, say 95%, the effective print density is limited to some percentage of the print density maximum, say 75%, by slowing the carriage. In this case, 466 includes comparing DAVG to DINKMAX. If DAVG>DMAX or if DAVG>DINKMAX, then 468 is performed to slow the printer carriage.

470 can include printing the swath using the carriage velocity calculated according to the swath pre-processing Eq. 2 set out above. The control logic monitors the printhead temperature and records the temperature parameters (e.g., TPEAK and TSTART), for later use.

DMAX is a potentially changing value that is maintained by the control logic based on known and measured characteristics of the printhead and TAMBIENT. The maximum possible ink flow rate for a given TAMBIENT establishes the upper limit of DMAX. That is, the upper limit of DMAX is established at a value that produces an average ink flow rate of less than or equal to the maximum possible ink flow rate. Subject to this upper limit, DMAX is updated during printer operation based on recorded start and peak temperatures for the printhead during previous swaths having known print densities.

In an example, the printer control logic calculates DMAX by monitoring actual swath dot density, the printhead start temperature TSTART and the peak printhead temperature TPEAK during each printhead swath and repeatedly (after each swath) calculates DMAX as a function of the actual swath dot density DACT, the start temperature TSTART, peak temperature TPEAK and the carriage velocity ratio. A DMAX is calculated so that a printhead swath in which DACT=DMAX results in a peak printhead temperature that does not exceed a maximum permissible peak printhead temperature TMAX.

DMAX is calculated by multiplying the actual swath dot density DACT of a particular printhead swath by a factor that is based at least in part on the peak temperature TPEAK of the printhead during the swath and upon a specified maximum permissible temperature TMAX of the printhead and by an ambient temperature factor. In the example described herein, the factor is equal to A*(TMAX−TSTART)/(TPEAK−TSTART); where TSTART is equal to the temperature of the printhead prior to the printhead swath. TSTART is a constant that approximates the printhead temperature at the beginning of each swath. In the described example, printhead control logic within printer heats or cools the printhead to a target temperature before each printhead swath. TSTART is equal to this target temperature. Printhead cooling is achieved by imposing a brief delay before an upcoming swath. Printhead heating is achieved by a technique known as "pulse warming," in which nozzles are repeatedly pulsed with electrical pulses of such short duration that they produce heat without ejecting ink.

DMAX is updated after each swath as follows:

$$\text{DMAX}=\text{DACT}*A*((\text{TMAX}-\text{TSTART})/(\text{TPEAK}-\text{TSTART}))$$

This equation is derived as follows: First, it is assumed that there is a linear relationship between printhead density D and printhead temperature T. Thus, $$T=m*\text{DACT}+\text{TSTART} \quad \text{(Eq. 3)}$$

Given this relationship, DMAX can be calculated in terms TMAX, TSTART, TAMBIENT, and the slope m:

$$\text{DMAX}=A*(\text{TMAX}-\text{TSTART})*C/m \quad \text{(Eq. 4)}$$

Solving for m, $$m=A*(\text{TMAX}-\text{TSTART})*C/\text{DMAX} \quad \text{(Eq. 5)}$$

Substituting Eq. 5 into Eq. 3 yields $$T=A*((\text{TMAX}-\text{TSTART})*C/\text{DMAX})*\text{DACT}*A+\text{TSTART} \quad \text{(Eq. 6)}$$

Solving for DMAX $$\text{DMAX}=\text{DACT}*A*((\text{TMAX}-\text{TSTART})*C/(T-\text{TSTART})) \quad \text{(Eq. 7)}$$

So, given a temperature TPEAK that occurs during a printhead swath having a density DACT, $$\text{DMAX}=\text{DACT}*A*((\text{TMAX}-\text{TSTART})*C/(\text{TPEAK}-\text{TSTART})) \quad \text{(Eq. 8)}$$

Actual changes to DMAX can be filtered to reduce fluctuations produced by measurement anomalies. One method of filtering is to clip each new value of DMAX at upper and lower limits. In this example, such clipping is performed if the printhead temperature TPEAK is outside a defined temperature range, where the range includes those temperatures that have been determined to be associated with a linear density/temperature relationship.

Another method of filtering is to damp any changes in the calculated DMAX. In the described example, this is done by multiplying changes to DMAX by a predetermined damping factor. In an example, upward changes in the calculated DMAX are damped by a first damping factor, and downward changes are damped by a second, different damping factor.

FIG. 4 illustrates a flow diagram of an example of a method 460 for ambient temperature based flow rates according to the present disclosure. For example, FIG. 4 illustrates at 472-480 calculation of DMAX. Blocks 472-480 can be performed repeatedly, for example, before, during, and/or after each printhead swath. DACT, TPEAK, and TAMBIENT can be recorded during the preceding swath, for example, and can be utilized in the calculations of FIG. 4.

As illustrated at 472 the method 460 comprises calculating DMAX as a function of DACT, TPEAK, and TAMBIENT, in accordance with equation 8 above. At 474 it is determined whether TPEAK is within a temperature range that exhibits a linear relationship to printhead density. For instance, 474 can comprise comparing TPEAK−TSTART with a predefined constant that represents the upper temperature limit of linear printhead behavior. For example, if TPEAK−TSTART is less than or equal to the constant, execution proceeds to 478. However, when TPEAK is greater than the constant, the method 460 proceeds to 476 and clipping DMAX at predefined upper and lower limits. As an example, the upper and lower limits might be set to 95% and 80%, respectively. Thus, at 476 DMAX is clipped (i.e., limited) to these values. Any value of DMAX above the upper limit is set equal to the upper limit.

Performed after the clipping described above, 478 comprises damping changes in DMAX from one printhead pass to another. To do this, the change ΔDMAX is calculated as the DMAX−DMAXOLD, where DMAXOLD is the value of DMAX calculated during the previous iteration of the method at 472-480. DMAX is then damped as follows: DMAX=DMAX−ΔDMAX/FDAMP, where FDAMP is a predetermined damping factor. Alternatively, two different damping factors can be used: one when ΔDMAX is positive, and another when ΔDMAX is negative. Furthermore, in some cases it may be advantageous to perform damping at 478 when the absolute value of ΔDMAX is greater than some predetermined density. This gives a range of ΔDMAX in which damping is not performed. The use of an intra-swath mode in accordance with an aspect of the disclosure can decrease and/or eliminate instances of dampening and/or increases the accuracy of the calculations.

480 comprises storing DMAX in non-volatile storage, for retention when the printer is turned off. This value of DMAX is used in 462, prior to the next printhead swath.

Note that the calculations above are based on an assumption that printhead thermal behavior is linear. This simplifies calculations and makes it possible to predict printhead temperatures without utilizing significant amounts of memory (e.g., non-volatile memory). Other approaches can be used. For example, a different mathematical model (other than the linear model) can be used to predict printhead thermal behavior. Alternatively, a table in printer memory can be maintained, indicating historical peak temperatures corresponding to different printhead densities. In this case, the table is used to determine DMAX rather than the linear model described above.

The method described above of reducing printhead density can be adapted to various different print methodologies. For example, many printers utilize swath overlapping to reduce banding. The principles explained above can be easily incorporated in such printers.

Figure 5:
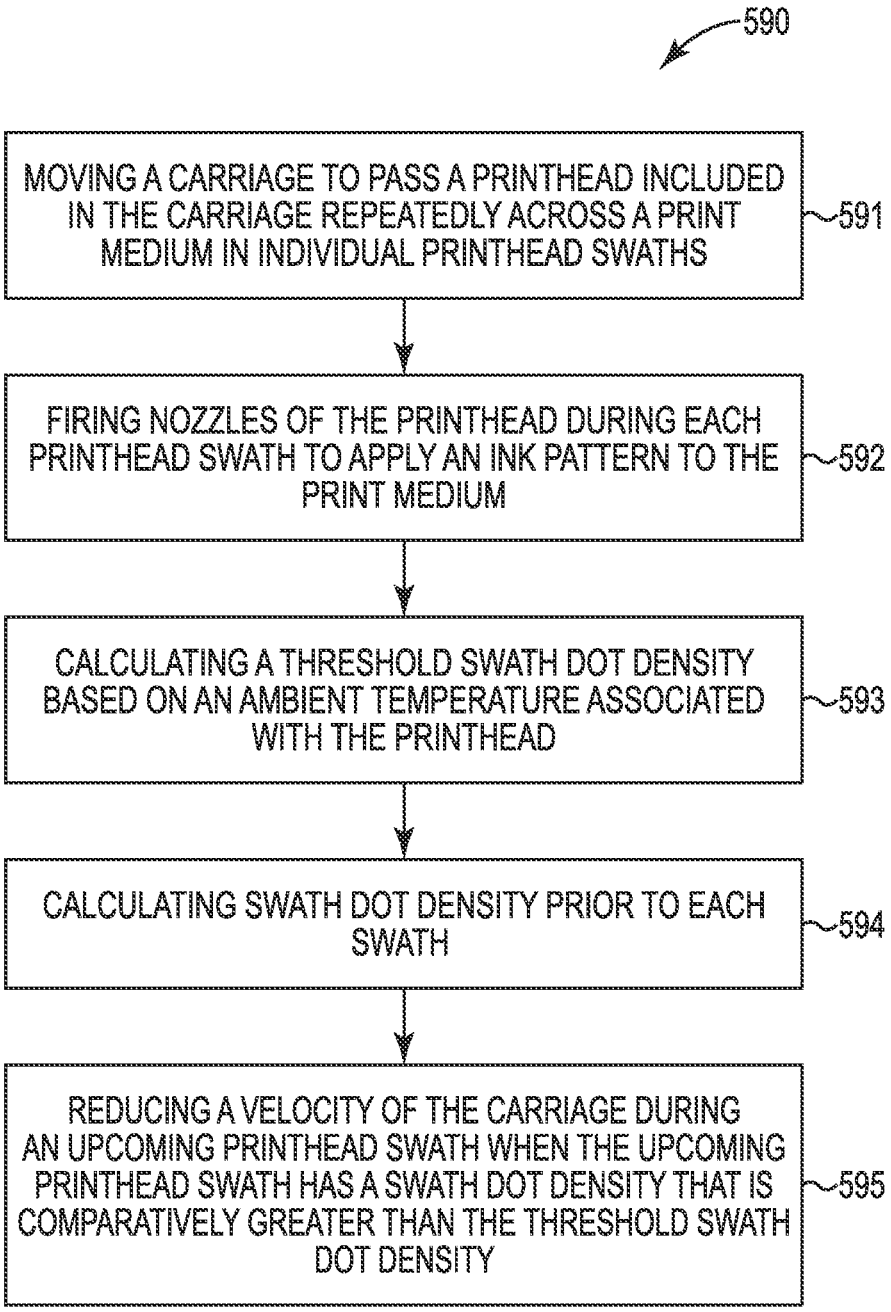
FIG. 5 illustrates a flow diagram of an example of a method for ambient temperature based flow rates according to the present disclosure.

FIG. 5 illustrates a flow diagram of an example of a method for ambient temperature based flow rates according to the present disclosure. As shown at 591, in various examples, the method 590 can include moving a carriage to pass a printhead included in the carriage repeatedly across a print medium in individual printhead swaths.

The method 590 can include firing nozzles (e.g., firing individual nozzles repeatedly) of the printhead during each printhead swath to apply an ink pattern to the print medium, as shown at 592. Firing refers to causing the ejection of ink from a nozzle.

As shown at 593, the method 590 can include calculating a threshold swath dot density, as described herein, based on an ambient temperature associated with the printhead. The method 590 can include calculating swath dot density prior to each swath (e.g., in response to receipt of a portion of a print job and/or prior to printing a portion of a print job), as shown at 594. Calculating can, in some examples, includes calculating a threshold swath dot density as a function of a derating factor that is based on an ambient temperature associated with a printhead, as described herein.

As shown at 595, the method 590 can include reducing a velocity of the carriage during an upcoming printhead swath when the upcoming printhead swath has a swath dot density that is comparatively greater than the threshold swath dot density. In some examples, reducing the velocity of the carriage results in production of a swath with a comparatively reduced print density (e.g., to a resultant print density that is comparatively less than a threshold print density).

In some examples, the method can include including displaying an indication of a threshold print density, a measured ambient temperature, a threshold flow rate of ink from an ink supply to a printhead and/or a measured volumetric flow rate of ink from an ink supply to a printhead, among other information. Displaying, for example, can include causing a display in response to receipt of a print job, a measured value (e.g., a measured ambient temperature) and/or in response to printing a portion of a print job.

In the foregoing detailed description of the present disclosure, reference is made to the accompanying drawings that form a part hereof, and in which is shown by way of illustration how examples of the disclosure may be practiced. These examples are described in sufficient detail to enable those of ordinary skill in the art to practice the examples of this disclosure, and it is to be understood that other examples may be utilized and that process, electrical, and/or structural changes may be made without departing from the scope of the present disclosure.

The figures herein follow a numbering convention in which the first digit corresponds to the drawing figure number and the remaining digits identify an element or component in the drawing. For example, reference numeral 102 may refer to element "02" in FIG. 1 and an analogous element may be identified by reference numeral 202 in FIG. 2. Elements shown in the various figures herein can be added, exchanged, and/or eliminated so as to provide a number of additional examples of the present disclosure. In addition, the proportion and the relative scale of the elements provided in the figures are intended to illustrate the examples of the present disclosure, and should not be taken in a limiting sense. Further, as used herein, "a number of" an element and/or feature can refer to one or more of such elements and/or features.

As used herein, "logic" is an alternative or additional processing resource to perform a particular action and/or function, etc., described herein, which includes hardware, e.g., various forms of transistor logic, application specific integrated circuits (ASICs), etc., as opposed to computer executable instructions, e.g., software firmware, etc., stored in memory and executable by a processor.

What is claimed:

1. A system, comprising:

a threshold engine to set a threshold flow rate of ink to a printhead mounted in a carriage, wherein the threshold flow rate of ink is set to an upper threshold flow rate that is comparatively greater than a base threshold flow rate when the measured ambient temperature associated with the printhead is above a predetermined upper temperature;

a measure engine to measure a flow rate of ink to the printhead; and a velocity engine to cause a decrease in a velocity of the carriage in response to the flow rate of ink satisfying the threshold flow rate.

2. The system of claim 1, wherein the velocity engine causes a decrease of at least one of a voltage or a pulse width of a voltage associated with the carriage.

3. The system of claim 1, wherein the velocity engine decreases the velocity of the carriage on an upcoming print swath sufficient to reduce the flow of ink rate of ink to be below the threshold flow rate.

4. The system of claim 1, including a determine engine to determine a swath dot density associated with a stored image being printed by the printhead.

5. The system of claim 1, wherein an increase in an ambient temperature corresponds to an increase in the threshold flow rate of ink.

6. The system of claim 1, wherein the threshold flow rate of ink is a particular value of volumetric flow rate of ink through tubes that couple the ink supply to the printhead and is based on the ambient temperature associated with the printhead.

7. A non-transitory computer readable medium storing instructions executable by a processing resource to cause a device to:

measure an ambient temperature associated with a printhead;

set a threshold flow rate of ink from an ink supply to a printhead mounted in a carriage, wherein the threshold flow rate of ink is set to an upper threshold flow rate that is comparatively greater than a base threshold flow rate when the measured ambient temperature associated with the printhead is above a predetermined upper temperature;

measure a volumetric flow rate of ink from an ink supply to the printhead; and decrease a velocity of the carriage in response to the volumetric flow rate of ink satisfying the threshold volumetric flow rate.

8. The medium of claim 7, wherein the instructions include instructions to measure the ambient temperature when the printhead is in an idle state.

9. The medium of claim 7, wherein the threshold volumetric flow rate of ink is variable based on measured ambient temperatures associated with a printhead.

10. The medium of claim 7, including instructions to set the threshold volumetric flow rate to an intermediate threshold flow rate when the measured ambient temperature is in a range from a predetermined intermediate temperature to a predetermined upper temperature.

11. The medium of claim 7, including instructions to measure the flow rate of ink as a volumetric flow rate of ink from the ink supply to the printhead.

12. A method, comprising:

measuring an ambient temperature when a printhead is in an idle state;

moving a carriage to pass the printhead included in the carriage repeatedly across a print medium in individual printhead swaths;

firing nozzles of the printhead during each printhead swath to apply an ink pattern to the print medium;

calculating a threshold swath dot density based on the ambient temperature associated with the printhead;

calculating swath dot density prior to each swath; and reducing a velocity of the carriage during an upcoming printhead swath when the upcoming printhead swath has a swath dot density that is comparatively greater than the threshold swath dot density.

13. The method of claim 12, wherein reducing the velocity of the carriage results in production of a swath with a comparatively reduced print.

14. The method of claim 12, wherein calculating includes calculating the threshold swath dot density as a function of a derating factor based on the ambient temperature associated with a printhead.

* * * * *